United States Patent [19]

Ryer et al.

[11] Patent Number: 4,589,991

[45] Date of Patent: May 20, 1986

[54] PROCESS FOR THE SOLUBILIZATION OF MERCAPTOBENZOTHIAZOLE IN A LUBRICATING OIL COMPOSITION

[75] Inventors: Jack Ryer, East Brunswick; Chung Kun Shih, Scotch Plains; John E. Williams, Cranford, all of N.J.

[73] Assignee: Exxon Research & Engineering Co., Florham Park, N.J.

[21] Appl. No.: 749,989

[22] Filed: Jul. 1, 1985

[51] Int. Cl.[4] ..... C10M 135/36

[52] U.S. Cl. ..... 252/47; 252/78.1; 544/135; 548/167

[58] Field of Search ..... 252/47, 78.1; 544/135; 548/167

[56] References Cited

U.S. PATENT DOCUMENTS

| | | | |
|---|---|---|---|
| 3,600,398 | 8/1971 | Svarz et al. | 548/167 |
| 4,182,873 | 1/1980 | Janin | 544/135 |
| 4,258,197 | 3/1981 | Loukan | 548/167 |
| 4,532,062 | 7/1985 | Ryer et al. | 252/47 |

*Primary Examiner*—Jacqueline V. Howard

*Attorney, Agent, or Firm*—Robert A. Maggio

[57] ABSTRACT

There is disclosed a process for the solubilization of a mercaptobenzothiazole amine salt with a solvent such as dihexyl phthalate which solubilized salt is in turn suitable for dissolution into a lubricating oil composition, such as an automatic transmission fluid, even at room temperature.

23 Claims, No Drawings

PROCESS FOR THE SOLUBILIZATION OF MERCAPTOBENZOTHIAZOLE IN A LUBRICATING OIL COMPOSITION

BACKGROUND OF THE INVENTION

The present invention relates to lubricating oil compositions, such as power transmission fluids which contain an improved additive, effective as a corrosion inhibitor, oxidation inhibitor and/or friction modifier as well as to a process for preparing such additive. More specifically, the present invention relates to amine or ammonium salts of mercaptobenzothiazole (MBI) solubilized with aromatic carboxylates as lubricating oil composition compatible additives.

Mercaptobenzothiazole has been used in power transmission shift fluids, such as automatic transmission fluid compositions, as a corrosion inhibitor. However, difficulties have been encountered in effectively solubilizing the material into the composition. Attempts have been made to use special solvents and blending techniques to deal with the compatibility problem. Thus, materials such as hexyl phthalate have been used as special solvents for the mercaptobenzothiazole additive. Such solvent systems, however, are still associated with compatibility problems. For example, while a 1:1 molar ratio mixture of mercaptobenzothiazole and dihexylphthalate results in solubilization of the mercaptobenzothiazole at 127° C., the mercaptobenzothiazole precipitates out of solution below this temperature. Consequently, such solutions cannot be effectively utilized for automatic transmission packages which are blended at temperatures of about 65° C.

Commonly assigned allowed U.S. patent application Ser. No. 573,122, filed Jan. 23, 1984, by Ryer, J., Bloch, R., and Deen, H., discloses the concept of employing a molar excess of amine (i.e., 1.2:1 and higher) to form the mercaptobenzothiazole salt with the excess amine acting to assist in solubilizing the salt. While this technique is advantageous, it would be of significant economic benefit if one could reduce the amount of amine employed because of its high cost, and yet still be capable of compatibly solubilizing the mercaptobenzothiazole in lubricating oil compositions. It is toward this goal that the present invention is directed.

By way of background, there are two general types of reactions of amines with mercaptobenzothiazole, namely, (1) the oxidative condensation of the amine with mercaptobenzothiazole to yield a sulfenamide, and (2) the formation of amine salts from mercaptobenzothiazole and the amine. Such reactions are distinct and the former does not pertain to the present invention. Moreover, neither type of reaction is known for use with the specific class of ester substituted benzenes in accordance with the present invention.

For example, U.S. Pat. No. 3,600,398 discloses the sulfenamide forming reaction in the presence of an oxidizing agent. A large excess of amine is disclosed to be necessary to prevent formation of the disulfide, e.g., at least 8:1 (Col. 2, Lines 55 et seq.). In addition, water is a required solvent although tetrahydrofuran in certain instances is a suitable alternative solvent, provided a ten-fold excess of amine is employed.

U.S. Pat. No. 4,258,197 also discloses a sulfenamide forming reaction in the presence of water or organic solvent. However, the only organic solvent disclosed is butyl cellosolve. When an organic solvent is used, the molar ratio of mercaptobenzothiazole to amine is 1:1.5 to 1:2. Moreover, even in the absence of the use of water as a solvent, at least 10% by weight of the reactants must be water to initiate the reaction.

U.S. Pat. No. 3,966,623 discloses a synergistic corrosion inhibiting combination of a specific thiadiazole and the amine salt of mercaptobenzothiazole for lubricating oil compositions. The method of preparing the mercaptobenzothiazole amine salt is not disclosed.

U.S. Pat. No. 3,539,512 discloses a grease composition which contains, in addition to five other required ingredients, a high molecular weight amine salt of mercaptobenzothiazole that functions as an anti-rust agent. The amine salts are disclosed as being prepared by reacting equivalent amounts of mercaptobenzothiazole and amine, generally at elevated temperatures (Col. 3, Line 37). However, it will be observed at Col. 4 that the grease formulation contains a polymer in oil dispersion, and the grease is generally milled. Obviously, the compatibility requirements of the mercaptobenzothiazole salt in grease are substantially different than in lubricating oil compositions. Moreover, no solvent at all is disclosed.

U.S. Pat. No. 2,437,170 discloses the use of the reaction product to mercaptobenzothiazole and dodecylamine as a fungicide, insecticide, mildew proofing agent, rot proofing agent, disinfectant, germicide, and an antifouling agent, for marine paints and for analogous purposes. The mercaptobenzothiazole and amine are reacted at a molar ratio thereof of 1:0.91. The end product of the reaction is a dry powder which can be dissolved in a suitable solvent. The disclosed solvents are xylol, toluol, butyl alcohol, ethyl alcohol, diacetone alcohol, and isophorone. It is also disclosed that the reaction may be carried out in the presence of a solvent or nonsolvent vehicle or both. No specific solvents are disclosed for this purpose and one must infer that the alcohols or ketones disclosed above define such solvents. The environments in which the mercaptobenzothiazole salt is employed are disclosed as being paints, enamels, lacqueres, as well as solutions of the salt alone for mildew proofing of cellulosic materials. Consequently, compatability in lubricating all compositions is not a consideration either from the standpoint the problems associated therewith or in relation to the solution to such problems.

SUMMARY OF THE INVENTION

The present invention relies on the discovery that certain solvents described hereinafter are capable of improving the handling capabilities, e.g., by solubilization, of certain amine salts of mercaptobenzothiazole even at room temperature and that such solutions are capable of being compatibly and directly admixed with lubricating oil compositions also at room temperature. By "compatible admixture" of the amine salt with the lubricating oil compositions is meant that the amine salt is homogeneously blended with, and remains completely soluble in, the lubricating oil composition after admixture therewith at temperatures of about 65° C. or lower, and preferably even when said admixture occurs while the lubricating oil composition and solution containing the amine salt are both at room temperature (i.e., about 20° to 25° C.). Moreover, the amine salts as defined herein are otherwise insoluble and/or so viscous in the absence of said solvents as to effectively preclude homogeneous blending of the same with lubricating oil composition (e.g., at conventional blending temperatures), and particularly at room temperature.

Thus, the present invention extremely simplifies the blending technique of the amine salt with the lube oil and permits one to store solution of the amine salt at room temperature for use when desired without having to design expensive and complicated blending techniques at elevated temperatures.

Accordingly, in one aspect of the present invention there is provided a process for preparing an amine salt solution of a substituted or unsubstituted mercaptobenzothiazole adapted for compatible admixture into a lubricating oil composition which comprises:

(1) reacting to form said salt, in the absence of an oxidizing agent, at least one mercaptobenzothiazole represented by the structural formula:

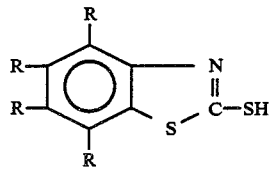

(I)

wherein each R independently represents hydrogen, alkyl, aryl, cycloalkyl, aralkyl or alkaryl; with at least one amine represented by the structural formula:

$$NR_1R_2R_3 \quad \text{(II)}$$

wherein $R_1$ and $R_2$ independently represent hydrogen or about $C_1$ to about $C_{20}$ alkyl, and $R_3$ represents alkyl or alkenyl having from about 6 to about 25 carbon atoms; and wherein the molar ratio at which said amine and mercaptobenzothiazole are reacted is from about 1.1:1 to about 0.7:1;

(2) admixing the amine salt prepared in accordance with Step (1) with at least one solvent in a manner and under conditions sufficient to render said salt soluble in said solvent at a temperature of not greater than about 65° C., said solvent being represented by the structural formula:

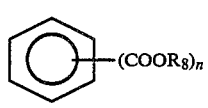

(IV)

wherein n represents a number of from 1 to 3, and each $R_8$ independently is selected from the group consisting of alkyl, cycloalkyl, aryl, aralkyl and alkaryl.

In another aspect of the present invention there is provided a process for solubilizing said amine salt in a lubricating oil composition.

In a still further aspect of the present invention there is provided a lubricating oil composition comprising the solubilized amine salt and solvent.

DESCRIPTION OF PREFERRED EMBODIMENTS

The mercaptobenzothiazole suitable for use in the present invention includes not only 2-mercaptobenzothiazole but also hydrocarbyl substituted, preferably monosubstituted, derivatives thereof which can be represented by the structural formula:

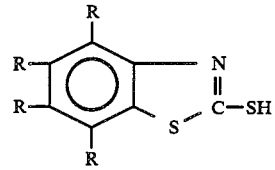

(I)

wherein each R independently represents hydrogen or a hydrocarbyl group selected from alkyl, typically $C_1$ to about $C_{10}$ alkyl, preferably $C_1$ to about $C_5$ alkyl, and most preferably $C_1$ to about $C_3$ alkyl, aryl, typically $C_6$ to about $C_{10}$ aryl, preferably $C_6$ aryl, cycloalkyl, typically $C_4$ to $C_8$ cycloalkyl, preferably $C_4$ to $C_6$ cycloalkyl, and aralkyl or alkaryl wherein the alkyl and aryl portions thereof are as described immediately above.

Representative examples of suitable mercaptobenzothiazole derivatives include 6-ethyl-2-mercaptobenzothiazole; 5-propyl-2-mercaptobenzothiazole, 7-benzyl-2-mercaptobenzothiazole, 5-phenyl-2-mercaptobenzothiazole, 5-cyclohexyl-2-mercaptobenzothiazole, 7-(2-ethylhexyl)-2-mercaptobenzothiazole as well as mixtures of the same.

The preferred mercaptobenzothiazole is 2-mercaptobenzothiazole wherein all R groups are hydrogen.

Amines suitable for reaction with the mercaptobenzothiazole to form the salt are generally, liquid, oil soluble primary, secondary and tertiary amines having up to about 30 carbon atoms and having one or more alkyl groups of at least about 6 carbon atoms. More specifically, such amines can be represented by the formula:

$$NR_1R_2R_3 \quad \text{(II)}$$

wherein $R_1$ and $R_2$ independently represent hydrogen or lower alkyl having typically from about 1 to about 20, preferably from about 1 to about 12, and most preferably from about 1 to about 6 carbons, and $R_3$ represents alkyl, alkenyl, or mixtures thereof each having typically from about 6 to about 25, preferably from about 9 to about 18, and most preferably from about 12 to about 18 carbon atoms.

Preferred amines for use in the present invention are tertiary alkyl primary amines wherein $R_1$ and $R_2$ of formula (II) are hydrogen, and $R_3$ is a tertiary alkyl group of the formula:

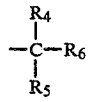

(IIa)

wherein $R_4$ and $R_5$ represent independently lower $C_1$–$C_4$ alkyl, preferably methyl, and $R_6$ represents a $C_9$ to $C_{19}$ alkyl group, e.g., $C_{15}$–$C_{19}$ alkyl, preferably mixed branched $C_{15}$–$C_{19}$ alkyl groups, or mixed branched $C_9$–$C_{11}$ alkyl groups.

The most preferred amines are those sold by Rohm and Haas under the tradename Primene JM-T and Primene 81-R. Primene 81-R and Primene JM-T are mixtures of highly branched tertiary alkyl primary amines where the alkyl configuration is essentially a repeating t-butyl group. The Primene 81-R alkyl groups have a carbon range from 11 to 14 carbons and the Primene JM-T have a carbon range of 18 to 22 carbons. Representative examples of preferred amines are those illustrated by the formula:

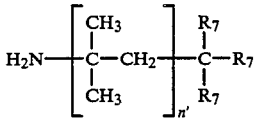

(III)

wherein n' represents a number which can vary from about 1 to about 5, preferably from about 2 to about 4, and each $R_7$ independently represents hydrogen or methyl.

Other suitable amines include dimethyloctadecyl amine, cocoamine, N,N-dimethyl-1-dodecanamine and N,N-dimethylcocoamine.

The solvent used to dissolve the amine in accordance with the present invention is a benzene mono-, di- or tri ester which can be represented by the formula:

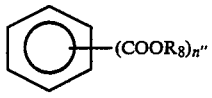

(IV)

wherein n'' represents a number which can vary from 1 to 3 and preferably is 2; and each $R_8$ independently is selected from alkyl, typically about $C_5$ to about $C_{15}$ alkyl, preferably about $C_6$ to about $C_{14}$ alkyl, and most preferably about $C_6$ to about $C_{10}$ alkyl; cycloalkyl, typically about $C_6$ to about $C_{10}$ cycloalkyl, preferably about $C_7$ to about $C_{10}$ cycloalkyl, and most preferably about $C_8$ to about $C_{10}$ cycloalkyl; aryl, typically about $C_6$ to about $C_{10}$ aryl, preferably $C_6$ aryl, alkaryl and aralkyl wherein the alkyl and aryl portions thereof are as described immediately above.

Representative examples of suitable solvents include, dihexyl isophthalate, dihexyl, phthalate, dicyclohexyl phthalate, hexyl benzene carboxylate, 1,3,5-trihexyl benzene tricarboxylate, dioctyl phthalate, octyl benzene carboxylate, 1,2,5-trioctyl benzene tricarboxylate, ditridecyl phthalate, diphenyl phthalate, and mixtures thereof.

The preferred solvent is dihexyl phthalate.

The mercaptobenzothiazole salt is prepared in the absence of an oxidizing agent by reacting the amine with the —SH group of the mercaptobenzothiazole and/or derivative thereof at a molar ratio of not greater than 1.1 (e.g., 1), preferably not greater than 0.9, and most preferably not greater than 0.8 moles of amine per mole of mercaptobenzothiazole and/or derivative thereof and such amine: mercaptobenzothiazole ratios will vary typically from about 1.1:1 to about 0.7:1, preferably from about 0.9:1 to about 0.8:1, and most preferably about 0.85:1 to about 0.9:1.

The reaction is typically carried out by adding the mercaptobenzothiazole and/or derivative thereof to the liquid amine in the absence of the solvent. The heat of neutralization typically autogeneously increases the reaction mixture temperature from about 25° to about 45° C. The reaction mixture temperature is then increased to a temperature of typically from about 45 to about 120, preferably from about 45 to about 100, and most preferably from about 45° to about 80° C. with stirring and maintained thereat for a period of typically from about 0.5 to about 5, preferably from about 1 to about 3, and most preferably from about 1 to about 1.5 hours until the reaction is substantially complete.

The atmosphere under which the salt forming reaction is carried out is typically inert and includes nitrogen, although air can be used.

The reaction pressure is typically atmospheric although subatmospheric or superatmospheric pressures can be employed.

The solvent is then added, typically while the reaction mixture is at reaction temperature but the heat source has been removed. The reaction mixture is then stirred and typically allowed to cool to room temperature. The resulting mercaptobenzothiazole salt is soluble in the solvent at a blending temperature of from about 20 to about 65, preferably from about 20 to about 40, and most preferably from about 20° to about 25° C. The resulting solution can therefore be stored at room temperature, until needed and can be added directly to the lubricating oil composition also at room temperature. This is a particular advantage because it overcomes the problem of insolubilization of the salt as it cools in plant lines even if the salt is added to the lube oil composition immediately after manufacture.

In addition, the reduced amount of amine reslts in a savings of materials cost while still producing a product having the advantages described herein.

Moreover, since the mercaptobenzothiazole salt solution is compatible with the lubricating oil composition, the mercaptobenzothiazole salt remains solubilized in said lube oil compositions at room temperature.

The amount of solvent employed to dissolve the mercaptobenzothiazole salt is based on the degree of fluidity sought to be imparted to the solution at blending temperatures. Such amounts preferably are sufficient to dissolve the mercaptobenzothiazole salt at room temperature (i.e., 20° to 25° C.).

Typically, blending procedures become increasingly more efficient as the viscosities of the mercaptobenzothiazole salt solution and the lube oil composition into which it is blended approach each other, e.g., within ±50% of each other.

Accordingly, while any effective amount of solvent can be employed, it is contemplated that such effective amount constitute that sufficient to achieve a molar ratio of mercaptobenzothiazole to solvent of typically from about 1:0.3 to about 1:5, preferably from about 1:0.9 to about 1:5, and most preferably from about 1:3 to about 1:5.

If the solvent is added at the beginning of the reacion, an imide can form which is not desirable. Moreover, if the amine is added to the mercaptobenzothiazole rather than vice versa, all the mercaptobenzothiazole will not be solubilized in the amine at reaction temperature.

If the solvent is omitted, a taffy like substance is produced at room temperature.

The base oil into which the mercaptobenzothiazole salt solution is added is a lubricating oil, typically a mineral lubricating oil, which can benefit from properties imparted thereto.

More specifically, the lubricating oil base stocks used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for exaple, by solvent extraction with solvents of the type of phenol, sulfur dioxide furfural, dichlorodiethyl ether, nitrobenzene, crotonaldehyde, etc.

The lubricating oil base stock ordinarily has a viscosity of about 40 to about 350 Saybolt seconds (SUS) at 100° F.

The lubricating oil base stock typically is adapted to perform a selected function by the incorporation of additives therein to form lubricating oil compositions.

One broad class of lubricating oil compositions suitable for use in conjunction with the additive solution of the present invention are power transitting fluids, including automatic transmission fluids, hydraulic fluids, heavy duty hydraulic fluids, power steering fluids, tractor universal oils, and the like.

The benefits of the additive solution of the present invention are particularly significant when employed in a lubricating oil adapted for use as an automatic transmission fluid.

Automatic transmission fluids (ATF) are compounded from a number of additives each useful for improving a chemical and/or physical property of the same. The additives are usually sold as a package in which mineral oil is present. The mineral lubricating oil will constitute from 40 to 60 weight percent of the package and typically is a refined hydrocarbon oil or a mixture of refined hydrocarbon oils selected according to the viscosity requirements of the particular ATF, but typically would have a viscosity range of 34–150, e.g., 75–150; SSU at 37.8° C. Suitable base oils include a wide variety of light hydrocarbon mineral oils, such as, naphthenic base, paraffin base, and mixtures thereof.

Additives present in such packages include viscosity improvers, corrosion inhibitors, oxidation inhibitors, friction modifiers, dispersants, demulsifiers, anti-foaming agents, anti-wear agents, pour point depressants and seal swellants.

Viscosity modifiers which can be employed include polyisobutylene, copolymers of ethylene and propylene, methacrylate copolymers, co-polymers of an unsaturated dicarboxylic acid and vinyl compound, and interpolymers of styrene and acrylic esters.

Corrosion inhibitors, also known as anti-corrosive agents, reduce the degradation of the metallic parts contained by the ATF. Illustrative of corrosion inhibitors are zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorous for ½ to 15 hours, at a temperature in the range of 150° to 600° F. Neutralization of the phosphosulfurized hydrocarbon may be effected in the manner taught in U.S. Pat. No. 2,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g., calcium nonylphenol sulfude, barium t-octylphenol sulfide, zinc dialkyldithiophosphates, dioctylphenylamine, phenylalphanaphthylamine, phosphosulfurized or sulfurized hydrocarbons, etc.

Dispersants maintain oil insolubles, resulting from oxidation during use, in suspension in ATF thus preventing sludge flocculation and precipitation. Suitable dispersants include high molecular weight alkyl succinates, the reaction product of oil-soluble polyisobutylene succinic anhydride with ethylene amines such as tetraethylene pentamine and borated salts thereof.

Pour point depressants lower the temperature at which the ATF will flow or can be poured. Such depressants are well known. Typical of those additives which usefully optimize the low temperature fluidity of the ATF are $C_8$–$C_{18}$ dialkylfumarate vinyl acetate copolymers, polymethacrylates, and wax naphthalene condensation products.

Foam control is provided by an anti-fomant of the polysiloxane type, e.g., silicone oil and polydimethyl siloxane.

Anti-wear agents, as their name implies, reduce wear to transmission parts. Representative of suitable anti-wear agents are zinc dialkyldithiophosphate, zinc diaryldithiophosphate and magnesium sulfonate.

Some of these numerous additives can provide a multiplicity of effects, e.g., a dispersant-oxidation inhibitor. This approach is well known and need not be further elaborated herein.

Seal swellants include mineral oils of the type that provoke swelling, including aliphatic alcohols of 8 to 13 carbon atoms such as tridecyl alcohol, with a preferred seal swellant being characterized as an oil-soluble, saturated, aliphatic or aromatic hydrocarbon ester of from 10 to 60 carbon atoms and 2 to 4 ester linkages, e.g., dihexylphthalate, as are described in U.S. Pat. No. 3,974,081.

ATF compositions containing these conventional additives are typically blended into the mineral oil base in the following ranges thereby providing their normal attendant function.

| Components | Vol % | Wt % |
|---|---|---|
| V.I. Improver | 1–15 | 1–16 |
| Corrosion Inhibitor | 0.01–1 | .01–1.5 |
| Oxidation Inhibitor | 0.01–1 | .01–1.5 |
| Dispersant | 0.5–10 | 0.5–11 |
| Pour Point Depressant | 0.01–1 | .01–1.5 |
| Demulsifier | 0.001–0.1 | .001–0.15 |
| Anti-Foaming Agents | 0.001–0.1 | .001–0.15 |
| Anti-Wear Agents | 0.001–1 | .001–1.5 |
| Seal Swellant | 0.1–5 | 0.1–6 |
| Friction Modifiers | 0.01–1 | .01–1.5 |
| Mineral Oil Base | Balance | Balance |

In a broad sense therefore, the additive solution of the present invention is employed in a lubricating oil composition comprising a major amount of a lubricating oil and a minor amount of the additive solution effective to impart one or more of the properties described herein. Additional conventional additives selected to meet the particular requirements of a selected type of lubricating oil composition can be included as desired.

Accordingly, while any effect amount of the additive solution can be incorporated into the lubricating oil composition, it is contemplated that such effective amount be sufficient to provide said lube oil composition with an amount of mercaptobenzothiazole salt of typically from about 0.1 to about 2, preferably from about 0.1 to about 1.5, and most preferably from about 0.1 to about 1%, by weight based on the weight of said composition.

The additive solution of the present invention can be incorporated into the lubricating oil in any convenient way. Thus, it can be added directly to the oil by dissolving the same in the oil at the desired level of concentration. Such blending can occur at room temperature or elevated temperatures. Alternatively, the additive solution may be blended with a base oil to form a concentrate, and then blending this concentrate with lubricating oil base stock to obtain the compositions of this invention. A typical concentrate will have a concentration of about 30 to about 60%, by weight of mercaptobenzothiazole salt additive. The concentration of the mercaptobenzothiazole salt additive in the concentrate is not critical.

When other additives are employed, it may be desirable, although not necessary, to prepare additive concentrates comprising concentrated solutions of the mercaptobenzothiazole salt together with said other additives whereby the several additives can be added simultaneously to the base oil to form the lubricating oil composition. Dissolution of the additive concentrate into the lubricating oil may be facilitated by mixing accompanied with mild heating, but this is not essential. Thus, the additive solution of the present invention can be added to small amounts of base oil or other compatible solvents along with other desirable additives to form concentrates containing typically 30 to 60% additives in the appropriate proportions. The stability of the additive solution of the present invention facilitates the preparation of such concentrates.

The following examples are given as specific illustrations of the claimed invention. It should be understood, however, that the invention is not limited to the specific details set forth in the examples. All parts and percentages in the examples as well as in the remainder of the specification are by weight unless otherwise specified.

EXAMPLE 1

To 180 g (0.9 moles) of Primene 81-R, represented by formula III wherein n' is 2 and each $R_7$ is methyl, was added while stirring 167 g (1.0 moles) of 2-mercaptobenzothiazole. The temperature was allowed to rise to 45° C. and the mixture was then heated to 80° C. and stirred for one hour thereat under a nitrogen blanket. The $N_2$ was removed and 347 g (1.04) moles of dihexyl phthalate was added, with stirring, to the reaction mixture at 80° C., the heat was removed, and the resulting solution allowed to cool to room temperature for 30 minutes. The resulting solution had a dinematic viscosity of 6.4 cst at 100° C. The solution at room temperature was stable and homogeneous and was readily soluble and miscible with a formulated automatic transmission fluid.

EXAMPLE 2

To a formulated automatic transmission fluid (Base Fluid) was added 0.31 wt% of the amine salt additive solution prepared in accordance with Example 1 and the fluid was evaluated for its anti-corrosion properties and anti-oxidation properties.

Copper and brass corrosion tests were conducted which comprised immersing copper and brass specimens $3\times\frac{1}{2}\times1/6$ inches weighed to 0.1 milligram in 40 cc. of the Base Fluid and additive solution and maintaining the specimens in the fluid at 300° F. for 65 hours. Thereafter the specimens are washed in hexane, rubbed to remove any loose deposits and reweighed. The results were 15 mg copper loss and 1 mg brass loss. These results satisfy current commercial specifications for automatic transmission fluids such as the General Motors Corp. Dexron ®II specifications for ATF.

The Base Fluid of this Example containing the amine salt additive solution of this invention was also evaluated in accordance with the General Motors Corp. Turbo Hydra Matic Oxidation Test (THOT) (Specification GM 6137-M) which evaluates sludge or varnish deposits, oxidation by increase in TAN (Total Acid Number) and by increase in IR carbonyl group absorbance, copper corrosion and braze alloy cooler corrosion. The results are as follows: Sludge, Pass; $\Delta TAN=3.7$; $\Delta IR=0.51$ copper, 64 ppm, Cooler Corrosion, Pass. These results satisfy the THOT requirements and indicate the corrosion and oxidation inhibiting effect of the additive of this invention.

EXAMPLE 3

The friction modification properties of the additive solution of this invention were demonstrated by adding 0.31 wt% of the additive solution prepared in accordance with Example 1 to a formulated SAE quality universal heavy duty oil for diesel equipment transmissions which contained conventional amounts of dispersant, metal detergent additives, zinc antiwear additives, viscosity index improver and antioxidant. This oil successfully passed the Allison C-3 Friction Retention Test, which utilizes an SAE-2 friction machine that must operate successfully in accordance with the test for a period of 50 hours with a maximum slip of less than 50 seconds, the torque at 0.2 seconds must be a minimum of 75 ft.-pounds and the decrease in torque during the test (1500–5500 cycles) must be less than 30 ft. lbs. Unmodified mercaptobenzothiazole will not pass this test and will not function effectively as a friction modifier.

COMPARATIVE EXAMPLE 1

Example 1 was repeated with the exception that the dihexyl phthalate was omitted. Upon cooling, a taffy like substance was formed.

COMPARATIVE EXAMPLE 2

2-mercaptobenzothiazole (1 mole) was mixed with 347 g of dihexyl phthalate at about 130° C. and the solution cooled to room temperature. The mercaptobenzothiazole precipitated out of solution below 127° C. and remained insolubilized at room temperature.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A process for preparing an amine salt solution of a substituted or unsubstituted mercaptobenzothiazole solubilized at room temperature and adapted for compatible admixture into a lubricating oil composition which comprises:

(1) reacting to form said salt, in the absence of an oxidizing agent, at least one mercaptobenzothiazole represented by the structural formula:

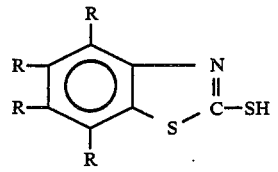

(I)

wherein each R independently represents hydrogen, alkyl, aryl, cycloalkyl, aralkyl or alkaryl; with at least one amine represented by the structural formula:

$NR_1R_2R_3$ (II)

wherein $R_1$ and $R_2$ independently represent hydrogen or about $C_1$ to $C_{20}$ alkyl, and $R_3$ represents alkyl or alkenyl having from about 6 to about 25 carbon atoms; and wherein the molar ratio at which said amine and mercaptobenzothiazole are reacted is from about 1.1:1 to about 0.7:1;

(2) admixing the amine salt prepared in accordance with Step (1) with at least one solvent in a manner and under conditions sufficient to render said salt soluble in said solvent at room temperature, said solvent being represented by the structural formula:

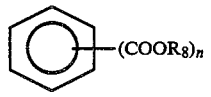

(IV)

wherein n represents a number of from 1 to 3, and each $R_8$ independently is selected from the group consisting of alkyl, cycloalkyl, aryl, aralkyl and alkaryl.

2. The process of claim 1 wherein the mercaptobenzothiazole is 2-mercaptobenzothiazole; the amine is a tertiary alkyl primary amine wherein in said formula II, $R_1$ and $R_2$ are hydrogen, and $R_3$ represents a tertiary alkyl group represented by the formula:

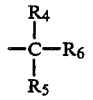

(IIa)

wherein $R_4$ and $R_5$ independently represent about $C_1$ to $C_4$ alkyl and $R_6$ represents about $C_9$ to $C_{19}$ alkyl.

3. The process of claim 1 wherein the amine is represented by the formula:

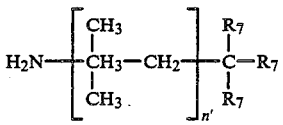

(III)

wherein n′ is a number which can vary from about 1 to about 5, and each $R_7$ independently represent hydrogen or methyl.

4. The process of claim 1 wherein the ratio of amine to mercaptobenzothiazole is not greater than 0.9:1.

5. The process of claim 1 wherein the amine salt is admixed with solvent in an amount sufficient to achieve a molar ratio of mercaptobenzothiazole in said salt to solvent of from about 1:3 to about 1:5.

6. The process of claim 1 wherein in formula (IV) n is 2 and $R_8$ is about $C_5$ to about $C_{15}$ alkyl.

7. The process of claim 6 wherein the solvent is dihexyl phthalate.

8. A lubricating oil composition comprising a major amount of mineral oil of lubricating viscosity and a minor amount of at least one substituted or unsubstituted mercaptobenzothiazole amine salt compatibly solubilized in said lubricating oil composition in an amount effective to improve at least one of the corrosion inhibition, oxidation inhibition, or friction modification properties of said lubricating oil composition relative to the absence of said amine salt, said compatible solubilization being achieved by a process which comprises:

(1) providing a solution of said amine salt dissolved in at least one solvent represented by the structural formula:

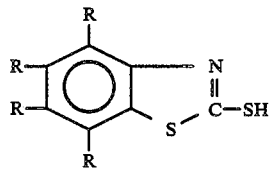

(I)

wherein n represents a number of from 1 to 3 and each $R_8$ independently is selected from the group consisting of alkyl, cycloalkyl, aryl, aralkyl and alkaryl; wherein said solution is stable at room temperature, and said amine salt has been prepared in accordance with a process comprising: reacting, in the absence of an oxidizing agent, at least one mercaptobenzothiazole represented by the structural formula:

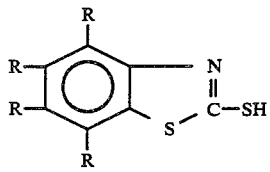

(I)

wherein each R independently represents hydrogen, alkyl, aryl, cycloalkyl, aralkyl or alkaryl; with at least one amine represented by the structural formula:

$NR_1R_2R_3$ (II)

wherein $R_1$ and $R_2$ independently represent hydrogen or about $C_1$ to $C_{20}$ alkyl, and $R_3$ represents alkyl or alkenyl having from about 6 to about 25 carbon atoms; and wherein the molar ratio at which said amine and mercaptobenzothiazole are reacted is from about 1.1:1 to about 0.7:1; and (2) admixing said amine salt solution with said lubricating oil.

9. The lubricating oil composition of claim 8 adapted for use as an automatic transmission fluid.

10. The lubricating oil composition of claim 8 wherein the amine salt is derived from the reaction of 2-mercaptobenzothiazole and a tertiary alkyl primary amine wherein in said formula II, $R_1$ and $R_2$ are hydrogen, and $R_3$ represents a tertiary alkyl group having the formula:

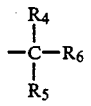

(IIa)

wherein $R_4$ and $R_5$ independently represent $C_1$ to $C_4$ alkyl and $R_6$ represents about $C_9$ to $C_{19}$ alkyl.

11. The lubricating oil composition of claim 10 wherein the molar ratio of amine to 2-mercaptobenzothiazole employed in forming the amine salt is not greater than 0.9:1.

12. The lubricating oil composition of claim 11 wherein $R_8$ of the solvent represented by formula IV is about $C_6$ to $C_{14}$ alkyl; and n is 2.

13. The lubricating oil composition of claim 11 wherein the solvent is dihexyl phthalate.

14. The lubricating oil composition of claim 8 wherein said solution is admixed with said lubricating oil at room temperature.

15. A process for solubilizing the amine salt of a substituted or unsubstituted mercaptobenzothiazole in a lubricating oil composition comprising mineral oil of lubricating viscosity, said amine salt being derived from the reaction of (a) at least one mercaptobenzothiazole represented by the structural formula:

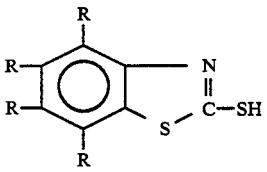

(I)

wherein each R independently represents hydrogen, alkyl, aryl, cycloalkyl, aralkyl or alkaryl and (b) at least one amine represented by the structural formula:

$$NR_1R_2R_3 \quad \text{(II)}$$

wherein $R_1$ and $R_2$ independently represent hydrogen or about $C_1$ to $C_{20}$ alkyl, and $R_3$ represents alkyl or alkenyl having from about 6 to about 25 carbon atoms, at a molar ratio of amine to mercaptobenzothiazole of from about 1:1 to about 0.7:1, which comprises admixing a solution of said amine salt with said lubricating oil, said solution being derived by the dissolution of said amine salt in at least one solvent represented by the structural formula:

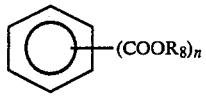

(IV)

wherein n represents a number of from 1 to about 3, and each $R_8$ independently is selected from the group consisting of alkyl, cycloalkyl, aryl, aralkyl, and alkaryl.

16. The process of claim 15 wherein said lubricating oil composition is adapted for use as an automatic transmission fluid.

17. The process of claim 15 wherein said lubricating oil composition is adapted for use as a concentrate suitable for use in preparing an automatic transmission fluid.

18. The process of claim 15 wherein the amine salt is derived from the reaction of 2-mercaptobenzothiazole and a tertiary alkyl primary amine wherein in said formula II, $R_1$ and $R_2$ are hydrogen and $R_3$ represents a tertiary alkyl group represented by the formula:

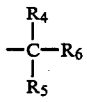

(IIa)

wherein $R_4$ and $R_5$ independently represent about $C_1$ to $C_4$ alkyl and $R_6$ represents about $C_9$ to $C_{19}$ alkyl.

19. The process of claim 18 wherein the amine is represented by the formula:

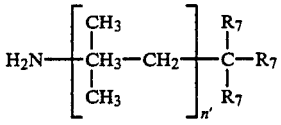

(III)

wherein n′ is a number which can vary from about 1 to about 5, and each $R_7$ independently represent hydrogen or methyl.

20. The process of claim 15 wherein the amine salt is admixed with solvent in an amount sufficient to achieve a molar ratio of mercaptobenzothiazole in said salt to solvent of from about 1:3 to about 1:5.

21. The process of claim 15 wherein the molar ratio at which the amine and mercaptobenzothiazole are reacted is not greater than 0.9:1.

22. The process of claim 15 wherein formula IV, $R_8$ represents about $C_5$ to $C_{15}$ alkyl and n is 2.

23. The process of claim 15 wherein the solvent is dihexyl phthalate.

* * * * *